United States Patent [19]

Hasegawa et al.

[11] 4,190,957

[45] Mar. 4, 1980

[54] CONTAINER OPENER AND METHOD OF UTILIZING THE SAME

[75] Inventors: Gary K. Hasegawa, Chicago; Carmen T. Mascia, Clarendon Hills, both of Ill.

[73] Assignee: The Continental Group, Inc., New York, N.Y.

[21] Appl. No.: 929,090

[22] Filed: Jul. 28, 1978

[51] Int. Cl.[2] ..... B67B 7/30

[52] U.S. Cl. ..... 30/411; 30/445; 83/30

[58] Field of Search ..... 30/411, 445, 448; 220/267; 83/30

[56] References Cited

U.S. PATENT DOCUMENTS

| | | | |
|---|---|---|---|
| 1,536,053 | 5/1925 | Baker | 30/445 |
| 1,813,620 | 7/1931 | Henry | 30/445 |
| 2,062,182 | 11/1936 | Kubitz | 30/411 |
| 2,916,818 | 12/1959 | Baselt | 30/448 X |
| 3,156,976 | 11/1964 | Hafstrom | 30/445 X |
| 3,931,905 | 1/1976 | Shumway | 30/411 X |

*Primary Examiner*—Gary L. Smith
*Attorney, Agent, or Firm*—Charles E. Brown

[57] ABSTRACT

A container opener particularly adapted for opening a container wherein the end wall of the container is provided with a preformed line of weakness. The container opener includes a closure member having depending therefrom an annular blade tapering in height for progressively effecting rupture along the line of weakness. A magnet is centrally located within the blade for retaining the cutout panel portion. The opener may be a simple device which is directly pushed toward the container manually, or may be incorporated in a suitable fixture including a base for supporting the container to be opened in a predetermined position.

5 Claims, 5 Drawing Figures

CONTAINER OPENER AND METHOD OF UTILIZING THE SAME

This invention relates in general to new and useful improvements in container opening means, and more particularly to an opener arrangement particularly adapted for use in conjunction with conventional cans having steel end units.

While many improvements in opening devices for cans have been developed in recent years, including the formation of easy opening end units wherein opening is effected by pulling on a suitable tab, there still remains a demand for relatively inexpensive cans suitable for use in packaging products such as food products. At the present time, end units for such cans must be opened with a can opener of the type which includes a blade for initiating the opening operation and a drive mechanism engageable with the double seam to effect relative motion between the blade and the end unit. Manual openers of this type are difficult to actuate, and as a result most openings of steel end cans are now effected by electric can openers. Even electric can openers have difficulties functioning with respect to all types of cans due to the inability to effectively grasp the double seam in a manner required to effect rotation of the can relative to a fixed blade. Further, conditions do not always exist where the utilization of an electric can opener is feasible.

In accordance with this invention, it is proposed to provide a steel end unit wherein the end panel thereof is provided with a peripheral line of weakening, preferably formed by scoring. This line of weakening defines the opening line of the end unit.

Next, it is proposed to provide for use in conjunction with a pre-scored steel end unit an opening device. Such opening device in its simplest form is in the form of a lid or cover which will overlie the end unit, and thus generally shield the person utilizing the same during the opening process. A blade depends from the underside of the cover and has an outline corresponding to the preformed line of weakening. Preferably, the outline of the line of weakness and that of the blade is circular so that orientation is not required. The blade tapers in height so that when it engages the end unit only a small portion of the blade is initially in contact with the end unit, and after initial rupture occurs the blade progressively severs the end unit at two points which eventually converge.

In order that the severed end panel portion may be retained and removed, the underside of the closure is also provided with a magnet of sufficient strength to attract and hold the severed end panel portion.

The closure may be manually manipulated and may be readily actuated by pressing down thereon with the palm area of one's hand. On the other hand, the opener may be incorporated in a suitable fixture so as to be lever actuated. The fixture preferably includes a base having formed therein a seat by means of which a can to be opened is accurately positioned with respect to the blade. The closure is vertically movable relative to the seat and is urged to an uppermost position by suitable return means. The fixture is provided with a handle incorporating therein a cam which is operable upon rotation to force the blade downwardly through the end unit. The return means may be selectively mounted beneath or above a supporting arm of the fixture.

When the opener is manually actuated, it may have a depending portion which will guide along the chuck wall of the end unit.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
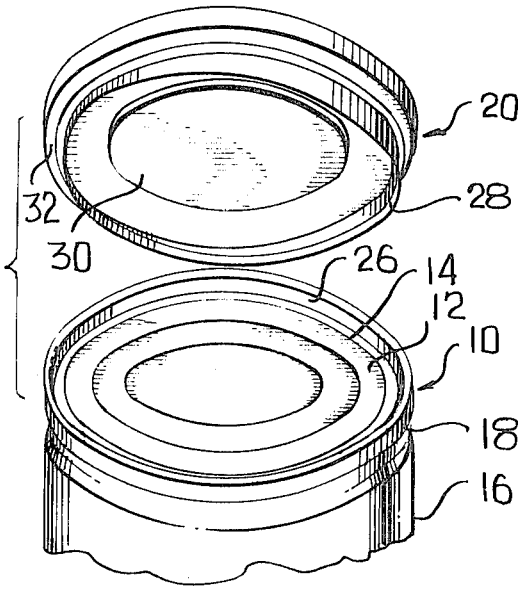
FIG. 1 is a fragmentary perspective view of an opener formed in accordance with this invention, and is shown in conjunction with an end unit to be opened thereby.

Referring now to the drawings in detail, it is to be seen that there is illustrated in FIG. 1 an end unit which is particularly adapted to be opened in accordance with this invention, the end unit being generally identified by the numeral 10. The end unit 10 is a conventional steel end unit with the exception of the fact that an end panel 12 thereof is provided with a peripheral weakening line 14 in the form of a score. The peripheral weakening line 14 is preferably circular in outline for reasons to be discussed hereinafter.

The end unit 10 is secured in a conventional manner to a can body 16 by means of a double seam 18. The can formed by the combination of the end unit 10 and the can body 16, as well as a bottom closure (not shown) is intended for use in the packaging of conventional products, such as fruits, etc.

Figure 2:
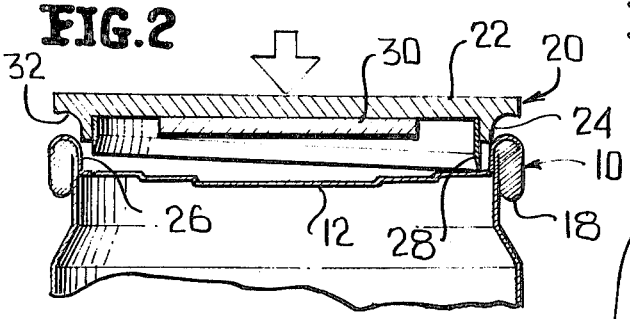
FIG. 2 is a fragmentary vertical sectional view taken through the upper end of the container of FIG. 1, with the opener positioned for initiating rupture of the end unit.

In accordance with this invention, there is provided an opener which is cooperable with the score line 14 for removing that portion of the end panel 12 defined by the score line 14. A simplified form of the opener is shown in FIGS. 1 and 2 and is generally identified by the numeral 20. The opener 20 includes a lid or cover 22 of a size conforming generally to that of the end unit 10 so as to serve both as a support component of the opener 20 and also as a suitable closure during the opening operation. It is to be noted that the cover 22 has a depending lip 24 which is movable into the interior of the end unit 10 in guided relation to the conventional chuck wall 26 thereof, as is best shown in FIG. 2.

The cover 22 has depending therefrom a blade 28 with a terminally sharpened edge. The blade 28 is of an outline corresponding to the outline of the score 14 and is automatically aligned with the score 14 by the engagement of the depending lip 24 with the chuck wall 26. As is best shown in FIG. 2, the blade 28 tapers in height so that only a limited portion of the blade 28 initially engages the end panel 12. A permanent magnet 30 is mounted on the underside of the cover 22 for attracting the central part of the chuck wall 12.

Operation

When it is desired to open the end unit 10 with the opener 20, the opener 20 is positioned in overlying relation to the end unit 10, as shown in FIG. 2. It is then depressed generally with the palm of one's hand, with the result that the blade 28, due to the guidance of the depending lip 24, will initiate rupture of the end panel 12 along a first portion of the line of weakness 14 with there being a progressive rupture of the end panel along that line of weakness in both directions with the two directions of progressive rupture converging remote from the initial point of rupture. As the blade 28 penetrates the end panel 12, the magnet 30 attracts the end panel and the severed portion therof is fully attracted to the magnet 30 and is retained thereby.

It is to be noted that the underside of the cover 22 has a peripheral seat 32 surrounding the depending lip 24. The seat 32 is engageable on the upper part of the double seam 18 to limit the downward movement of the blade 28. At the same time the lip 24 forms a general seal with the end unit 10 and prevent splashing or other discharging of the contents of the container during the opening operation.

Figure 3:
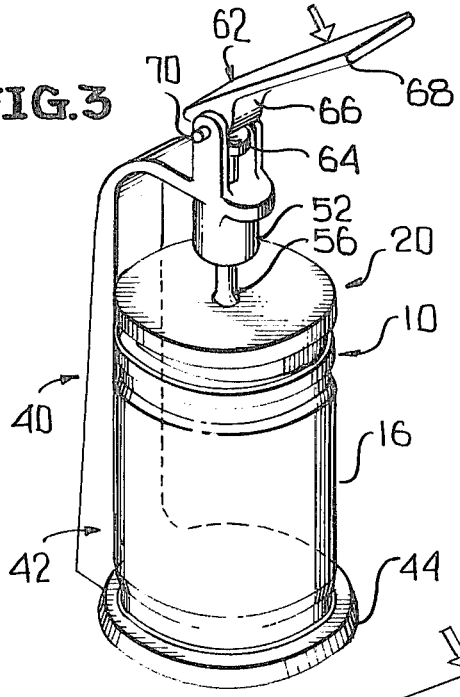
FIG. 3 is a top perspective view of a modified form of the opener.
Figure 4:
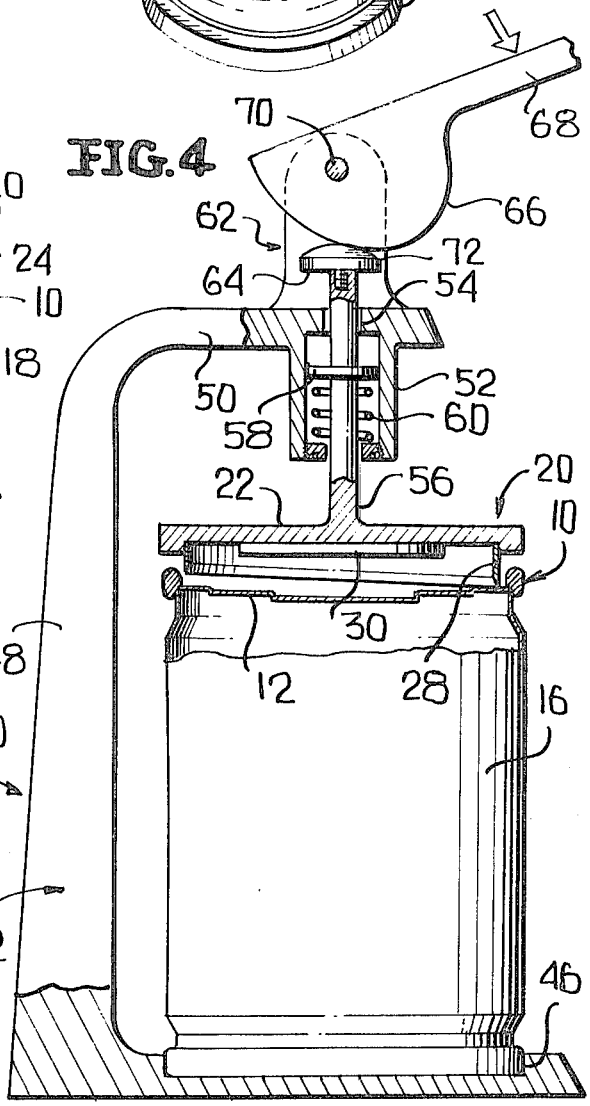
FIG. 4 is an enlarged side elevational view with parts broken away and shown in section of the opener of FIG. 1, and shows the opener applied to a container for the purpose of opening the container.

Reference is now made to FIGS. 3 and 4 wherein there is illustrated a modified form of opener, generally identified by the numeral 40. The opener 40 incorporates therein the opener 20, and includes a fixture 42 having a base 44 with a recessed seat 46 therein receiving the lower end of the container to be opened. By seating the container within the seat 46, alignment of the container is initiated.

The fixture 42 has a standard 48 extending upwardly from the rear of the base 44. The standard 48 terminates in an upper arm 50 which is provided with an integral depending sleeve 52. The upper part of the arm 50 in alignment with the sleeve 52 is provided with a guide wall 54 through which passes a stem or rod 56 extending upwardly from the cover 22 of the opener 20. Thus, the opener 20 is automatically aligned with the seat 46 and the container to be opened. It thus will be seen that if desired the depending lip 24 may be omitted, and the illustrated cover 22 is so constructed in FIG. 4.

Within the sleeve 52, a stem 56 is provided with an enlargement 58 against which a spring 60 bears upwardly to hold the opener 20 in a position wherein the container may be readily seated on the seat 46.

In order that the opener 20 may be readily actuated, there are provided actuator means 62 which include a head 64 on the stem 56 above the arm 60 and a cam 66 engageable with the head 64 to depress the same. The cam 66 is carried by a lever 68 which is pivotally mounted on a pin 70 carried by a pair of upstanding supports 72 extending upwardly from the arm 50.

Operation

When it is desired to utilize the opener 40, the handle 68 is disposed in a generally upstanding position, at which time the opener 20 is fully retracted by the spring 60. The container is then positioned in the seat 46 and is ready to be opened. All that is necessary is for one to move the handle 68 downwardly in a clockwise direction, as viewed in FIG. 4, with the cam 66 urging the head 64 downwardly with the result that the opener 20 is moved downwardly so that the blade 28 severs the end panel 12 of the end unit 10. The removed portion of the end panel is attracted by the magnet 30 and when the opener 20 is again moved upwardly by the spring 60, the removed panel portion remains attached to the magnet. It is to be understood that the blade 28, in combination with the cover 20, functions as a cover generally to prevent accidental splashing of the contents of the container during the opening operation.

Figure 5:
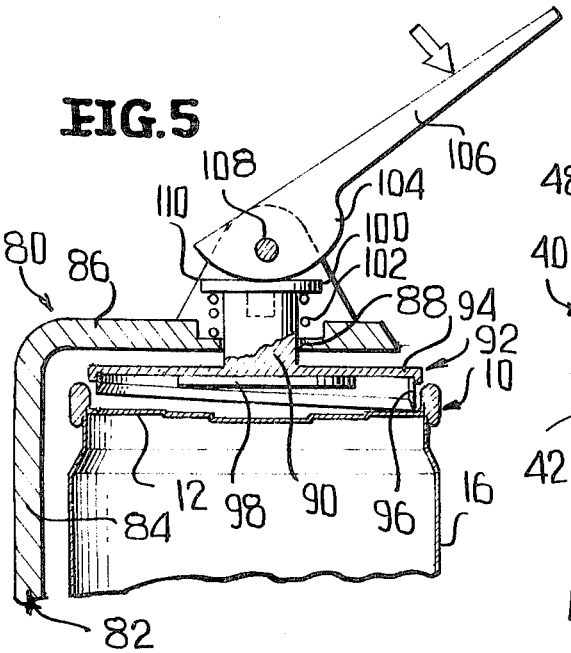
FIG. 5 is an enlarged fragmentary sectional view through a slightly modified form of opener.

Reference is now made to FIG. 5, wherein a still further form of opener, generally identified by the numeral 80, is illustrated. The opener 80 includes a fixture 82 which will have a base similar to the base 44 and includes an upstanding standard 84 terminating at its upper end in an arm 86 which overlies the base. The arm 86 has a guide bore 88 therethrough centered relative to the seat in the base. A stem 90 extends through the guide bore 88 and on the underside thereof has fixed thereto an opener device 92 including a cover 94, depending blade 96 tapering in height, and a magnet 98.

The stem 90 is provided with an enlarged head 100 beneath which there is engaged a spring 102 constantly urging the stem 90 and the opener device 92 to an upwardly recessed position which permits the container to be opened to be properly seated on the base.

A cam 104 carried by a lever or handle 106 is pivotally mounted on a pivot pin 108 carried by a air of upstanding supports 110. When the handle 106 is moved in a in a clockwise direction, the cam 104 depresses the stem 90 and moves the opener device 92 downwardly to sever the end panel 12 along the preformed line of weakness. The cover 94 in conjunction with the blade 96 forms a closure to avoid splashing or spillage during the opening process.

The opener 80 functions in essentially the same manner as that described above with respect to the opener 40.

Although only several preferred embodiments of the invention have been specifically illustrated and described herein, it is to be understood that minor variations may be made in the openers without departing from the spirit and scope of the invention as defined by the appended claims.

What is claimed is:

1. A method of opening a container comprising the steps of providing a container wall with a continuous line of weakening defining a removable panel, supplying a closure having a depending blade of a configuration corresponding to that of the line of weakening and tapering in height, positioning the closure in overlying relation to the container wall and aligning the blade with the line of weakening, and utilizing the closure both as a shield and a force applying member moving the blade in a straight line directly towards the container wall, and rupturing the container wall along the line of weakening, the continuous line of weakening being formed in a container end panel surrounded by a projecting seam, and the closure being engaged with the projecting seam to limit the penetration of the blade.

2. The method of claim 1 wherein when the closure is engaged with the projecting seam to limit the penetration of the blade the closure forms a seal with the projecting seam.

3. An opener particularly adapted for opening prescored steel end units of cans, said opener comprising a closure having depending therefrom a continuous annular blade tapering in height for progressively rupturing an end unit, said blade having a lower cutting edge and said closure being of an outline generally corresponding to the outline of an intended end unit and spaced closely above said blade cutting edge for forming a complete shield during the opening of an end unit, said closure having sealing means for forming a seal with an upstanding seam of an intended end unit.

4. The opener of claim 3 wherein said sealing means includes said closure being formed of a plastics material and having a sealing groove surrounding said blade.

5. The opener of claim 4 wherein said sealing groove is in part formed by a depending lip surrounding said blade in depending relation from the remainder of said closure and being of a size to be received within the upstanding seam of the intended end unit.

* * * * *